US005857134A

United States Patent [19]

Ahn

[11] Patent Number: 5,857,134

[45] Date of Patent: Jan. 5, 1999

[54] DEVELOPING UNIT OF AN ELECTROPHOTOGRAPHIC APPARATUS HAVING IMPROVED TONER SUPPLY ROLL

[75] Inventor: Byung-Sun Ahn, Suwon, Rep. of Korea

[73] Assignee: SamSung Electronics Co., Ltd., Suwon, Rep. of Korea

[21] Appl. No.: 917,067

[22] Filed: Aug. 25, 1997

[30] Foreign Application Priority Data

Aug. 24, 1996 [KR] Rep. of Korea ..... 1996-25778

[51] Int. Cl.[6] ..... G03G 15/08

[52] U.S. Cl. ..... 399/256; 399/258; 399/272; 399/281

[58] Field of Search ..... 399/254, 256, 399/272, 281, 258; 222/DIG. 1

[56] References Cited

U.S. PATENT DOCUMENTS

| | | | |
|---|---|---|---|
| 3,783,828 | 1/1974 | Forgo et al. | 399/272 X |
| 4,119,060 | 10/1978 | Mochizuki et al. . | |
| 4,561,766 | 12/1985 | Fox . | |
| 4,566,779 | 1/1986 | Kondoh . | |
| 4,619,523 | 10/1986 | Maeda et al. . | |
| 4,855,783 | 8/1989 | Takashima et al. | 399/256 |
| 4,992,834 | 2/1991 | Yamamoto et al. . | |
| 5,081,505 | 1/1992 | Ziegelmuller et al. . | |
| 5,243,390 | 9/1993 | Takemoto et al. . | |
| 5,315,357 | 5/1994 | Kamijo et al. . | |
| 5,319,461 | 6/1994 | Lindblad et al. . | |
| 5,338,895 | 8/1994 | Ikegawa et al. . | |
| 5,640,651 | 6/1997 | Katoh et al. | 399/281 X |

FOREIGN PATENT DOCUMENTS

| | | |
|---|---|---|
| 2-247669 | 10/1990 | Japan . |
| 3-231777 | 10/1991 | Japan . |

*Primary Examiner*—Arthur T. Grimley
*Assistant Examiner*—Quana Grainger
*Attorney, Agent, or Firm*—Robert E. Bushnell, Esq.

[57] ABSTRACT

A developing unit having a frame mounted in an electrophotographic apparatus with a photosensitive drum uses an agitator agitating toner contained in a toner receptacle of the frame of the developing unit, a developing roll for developing a latent image formed on the surface of the photosensitive drum with the toner, at least one toner supply roll with a cross-shaped blade mounted on a shaft for supplying the agitated toner to the developing roll, and a doctor blade for regulating the thickness of the toner layer formed on the toner developing roll so that the thickness of the toner layer is maintained at a given level. Each branch of the cross-shaped blade is tapered toward an outer end at a given angle so as to properly supply the toner to the developing roll.

10 Claims, 6 Drawing Sheets

DEVELOPING UNIT OF AN ELECTROPHOTOGRAPHIC APPARATUS HAVING IMPROVED TONER SUPPLY ROLL

CLAIM OF PRIORITY

This application makes reference to, incorporates the same herein, and claims all benefits accruing under 35 U.S.C. §119 from an application for *DEVELOPING UNIT OF AN ELECTROPHOTOGRAPHIC APPARATUS* earlier filed in the Korean Industrial Property Office on the 24th day of August 1996 and there duly assigned Ser. No. 25778/1996.

BACKGROUND OF THE INVENTION

1. Technical Field

The present invention concerns a developing unit provided in an electrophotographic apparatus, such as a laser beam printer, an electronic copier, an ordinary paper facsimile or a versatile office machine, and more particularly, a process and toner supply roll for supplying toner to the developing roll in such an electrophotographic apparatus.

2. Related Art

In the conventional developing apparatus, a toner tank stores toner, and a blade is provided for supplying toner from the toner tank to a developing roll. Typically, the blade for supplying toner to the developing roll is a simple blade having at least two branches. Such an arrangement is disclosed, for example, in U.S. Pat. No. 5,338,895 of Ikegawa et al., entitled *Developing Apparatus.*

A similar arrangement is disclosed in U.S. Pat. No. 5,243,390 of Takamoto et al., entitled *Device For Conveying Developer In A Developing Device*. The latter patent discloses a rotating member 12 for supplying toner to a developing roll, the rotating member 12 having a channel member located at its outer end, the channel member being somewhat tapered.

Other arrangements which are of general background interest are disclosed in the following patents: U.S. Pat. No. 5,319,461 to Lindblad et al., entitled *Apparatus For Increased Toner Storage Capacity*, U.S. Pat. No. 5,315,357 to Kamijo et al., entitled *Cleaning Unit Provided In Xerographic Image Forming Apparatus For Removing Residual Toner From An Image Carrier,* U.S. Pat. No. 5,081,505 to Ziegelmuller et al., entitled *Cleaning Apparatus Having Indexable Wiper Blades*, U.S. Pat. No. 4,992,834 to Yamamoto et al., entitled *Cleaning Blade Arrangement For Image Forming Apparatus*, U.S. Pat. No. 4,619,523 to Maeda et al., entitled *Toner Cleaning Apparatus In Electrophotography*, U.S. Pat. No. 4,566,776 to Kondoh, entitled *Magnetic Toner Developing Device*, U.S. Pat. No. 4,561,766 to Fox, entitled *Blade Cleaner Apparatus For Removing Toner From A Charge-Retentive Surface*, and U.S. Pat. No. 4,119,060 to Mochizuki et al., entitled *Toner Charging Apparatus.*

I have found that each of these arrangements is disadvantageously burdened by the fact that only a small portion of the toner is supplied to the developing roll. That is to say, the force provided by such rotating blades is too weak to supply a sufficient amount of toner to the developing roll as the blade rotates. Thus, printing quality of the developing roll is below acceptable standards.

I have also found that, in some conventional designs, because both sides of each branch of the blade of the toner supply roll are parallel to each other, the force required to push the toner toward the developing roll is insufficient to continuously supply a sufficient amount of toner to the developing roll. Consequently, I have noticed that not only does this deficiency lower the printing quality of the developing roll, but it also increases the amount of toner remaining in the toner receptacle.

SUMMARY OF THE INVENTION

Therefore, it is an object of the present invention to provide an improved process and toner supply roll.

It is another object to provide a developing unit of an electrophotographic apparatus with a toner supply roll having an improved blade to supply a proper amount of toner to the developing roll.

It is still another object to provide a developing unit of an electrophotographic apparatus for preventing the toner concentration from being diluted to achieve a printed image of high quality.

It is yet another object to provide a developing unit of an electrophotographic apparatus for minimizing the amount of toner remaining in the toner receptacle.

According to the present invention, a developing unit having a frame mounted in an electrophotographic apparatus with a photosensitive drum comprises an agitator for agitating toner contained in a toner receptacle of the frame of the developing unit, a developing roll for developing a latent image formed on the surface of the photosensitive drum with the toner, at least one toner supply roll with a cross-shaped blade mounted on a shaft for supplying the agitated toner to the developing roll, and a doctor blade for regulating the thickness of the toner layer formed on the toner developing roll at a given level. Furthermore, each branch of the cross-shaped blade is tapered toward the outer end at a given angle so as to properly supply toner to the developing roll.

The cross-shaped blade has at least an auxiliary film attached to one of the branches to enhance the supplying force of the toner supply roll. The auxiliary film is of sufficient size to be resiliently bent when contacting the inside of the frame so as to enhance the force for supplying the toner to the developing roll.

The present invention will now be described with reference to the drawings attached only by way of example.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
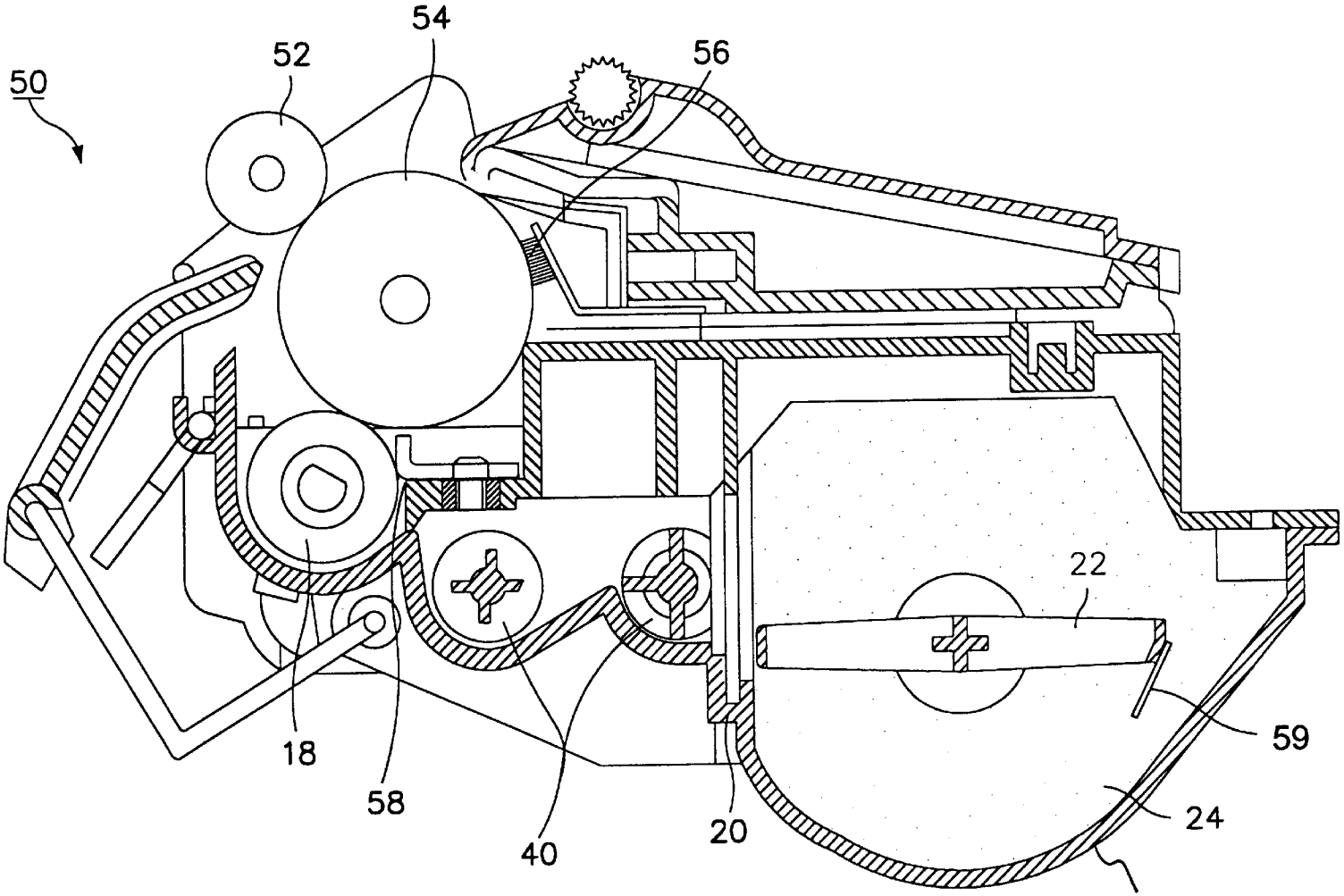
FIG. 1 (PRIOR ART)
FIG. 1 is a diagram illustrating the structure of the developing unit of a conventional electrophotographic apparatus.

In the drawings, the same reference numerals are used to represent parts having same functional relationship, and detailed descriptions are omitted concerning conventional parts or functions in order to prevent the present invention from being misunderstood.

The printing process of a conventional electrophotographic apparatus will be described with reference to FIG. 1. The developing unit 50 has a toner receptacle 23 for storing toner 24, which is agitated by an agitator 22 to charge it with static electricity by means of friction. The agitated toner 24 is transferred by film 59 attached to one end of agitator 22, through the rotation of toner supply roll 40 (shown in greater detail in FIG. 3), to developing roll 18, which is provided with a doctor blade 58 to regulate the thickness of the toner layer deposited on the surface of developing roll 18.

In the meantime, the surface of photosensitive drum 54 is uniformly charged by an electric charger 56 to have a negative voltage of about −1 KV. Then, photosensitive drum 54 is rotated to expose the negatively charged surface to the light beam produced by an exposing unit (not shown) in accordance with an electrical image signal, so that the exposed part has an electrical potential of about −0 to 50V. As a result, a latent image is formed, and the latent image is converted into a visible image by the toner on developing roll 18. Subsequently, a sheet of recording paper is picked up by a pickup roll (not shown) and is delivered to transfer roll 52, which is charged with a high voltage of about 1.2 to 1.3 KV, so as to transfer the toner image on photosensitive drum 54 to the sheet. The toner image transferred to the sheet is fixed by means of heat and pressure between a heating roll and a pressure roll of a fixing unit (not shown).

Figure 2:
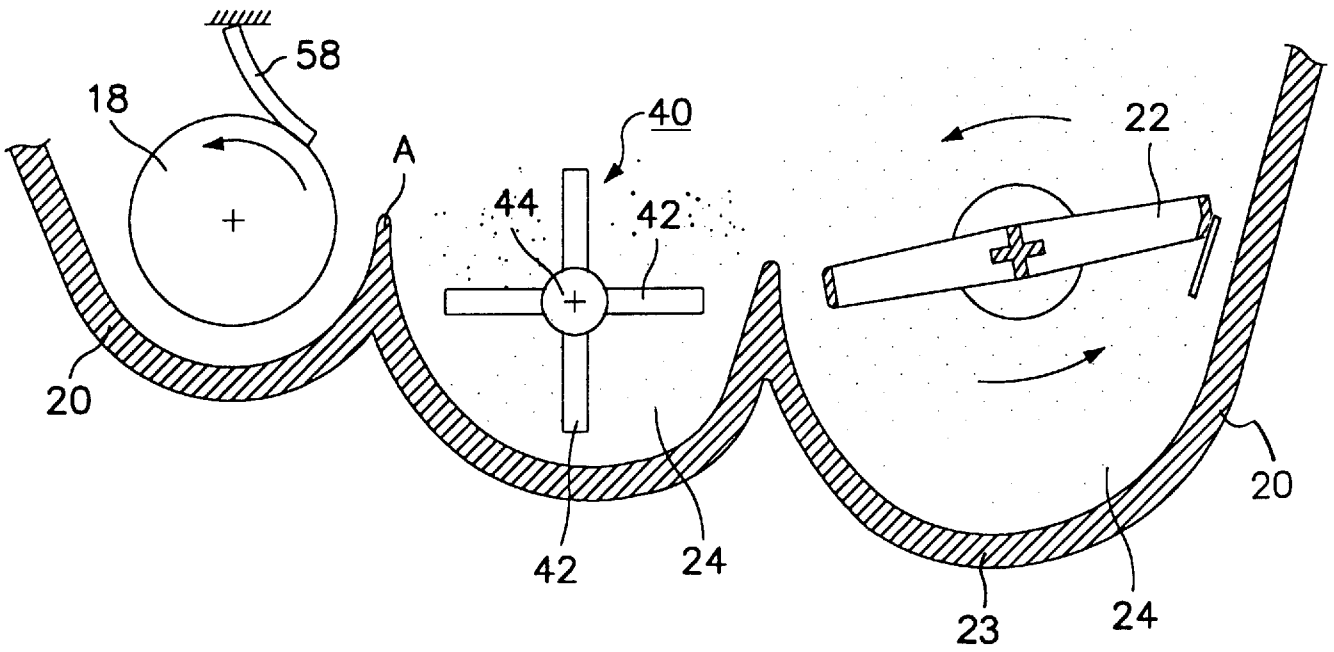
FIG. 2 (PRIOR ART)
FIG. 2 is a schematic diagram for illustrating the operation of the conventional toner supply roll.
Figure 3:
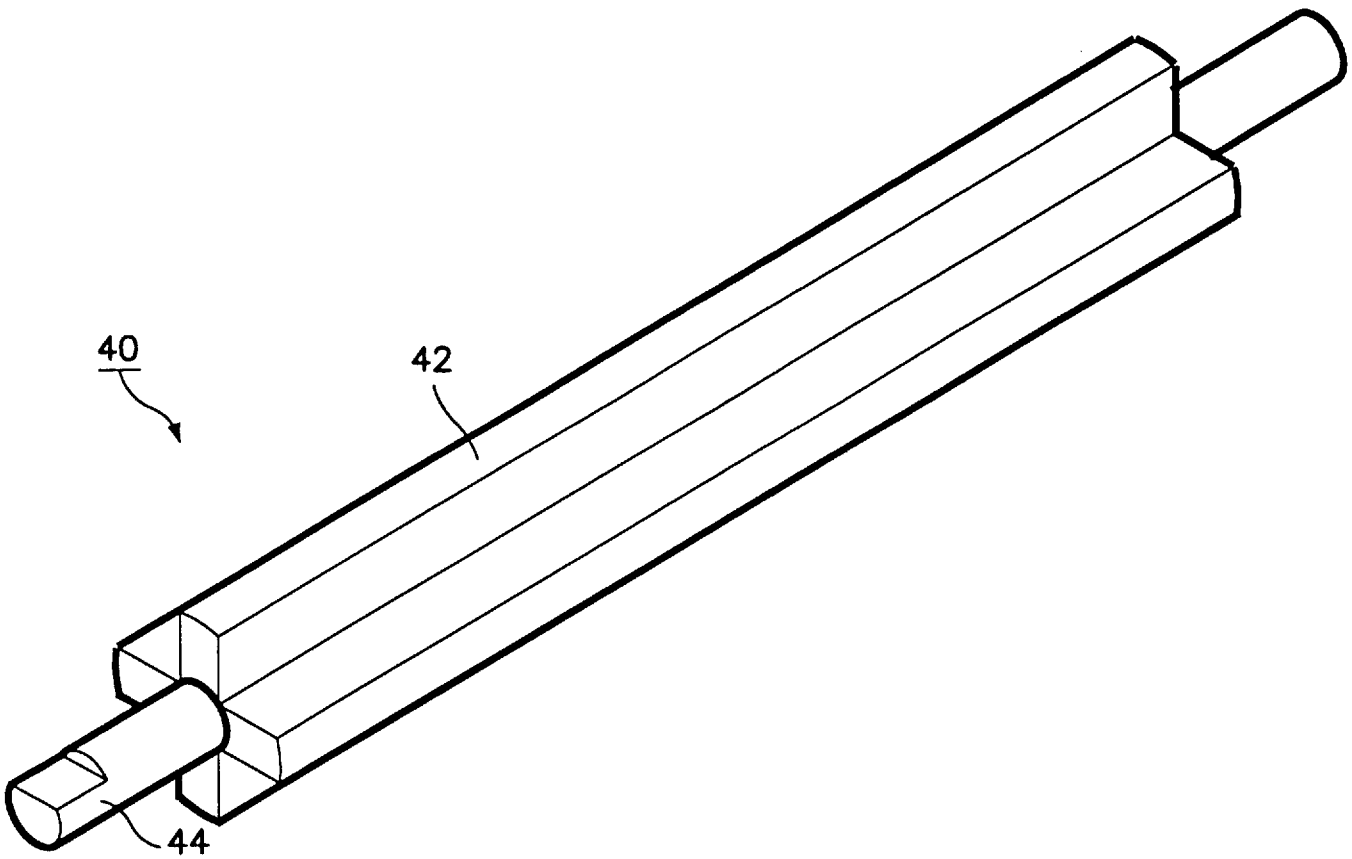
FIG. 3 (PRIOR ART)
FIG. 3 is a perspective view illustrating a conventional toner supply roll.

In such a conventional developing unit, the agitated toner may not be properly supplied to the developing roll 18. More specifically with reference to FIG. 2, agitator 22 is located inside frame 20 of the developing unit 50 for agitating toner 24 supplied to toner supply roll 40, which is installed to the left side of agitator 22 in FIG. 2 to supply agitated toner 24 to developing roll 18. Referring briefly to FIG. 3 in conjunction with FIG. 2, toner supply roll 40 typically has a shaft 44 driven by a drive motor (not shown) and a blade 42 rotated counterclockwise to deliver toner 24 to developing roll 18. The blade 42 is cross-shaped with four branches formed perpendicularly to one another. The developing roll 18 is installed to the left side of, and slightly higher than, toner supply roll 40 to develop a latent image formed on photosensitive drum 54, illustrated by FIG. 1, with toner 24. Also provided is a doctor blade 58 to regulate the thickness of toner 24 deposited on developing roll 18 at a given level.

In operation, the toner 24 contained in toner receptacle 23 of developing unit 50 illustrated in FIG. 1 is agitated by agitator 22, and is charged with static electricity produced by rubbing. The agitator 22 is rotated counterclockwise to deliver toner 24 to toner supply roll 40, which rotates blade 42 shown in FIG. 2 by means of shaft 44 driven by a drive motor (not shown). Then, toner 24 deposited on the surface of the blade is thrown toward developing roll 18, striking the boundary part "A" of frame 20 between toner supply roll 40 and developing roll 18, so that only a small portion of toner 24 is supplied to developing roll 18. The toner 24 deposited on developing roll 18 is regulated by doctor blade 58 at a given level.

Since both sides of each branch of blade 42 of toner supply roll 40 are formed parallel to each other, the force to push toner 24 toward developing roll 18 is too weak to supply a sufficient amount of toner 24 to developing roll 18 when rotating blade 42. Hence, not only does the printing quality of developing roll 18 become lowered, but also the amount of toner 24 remaining in toner receptacle 23 is increased.

Figure 4:
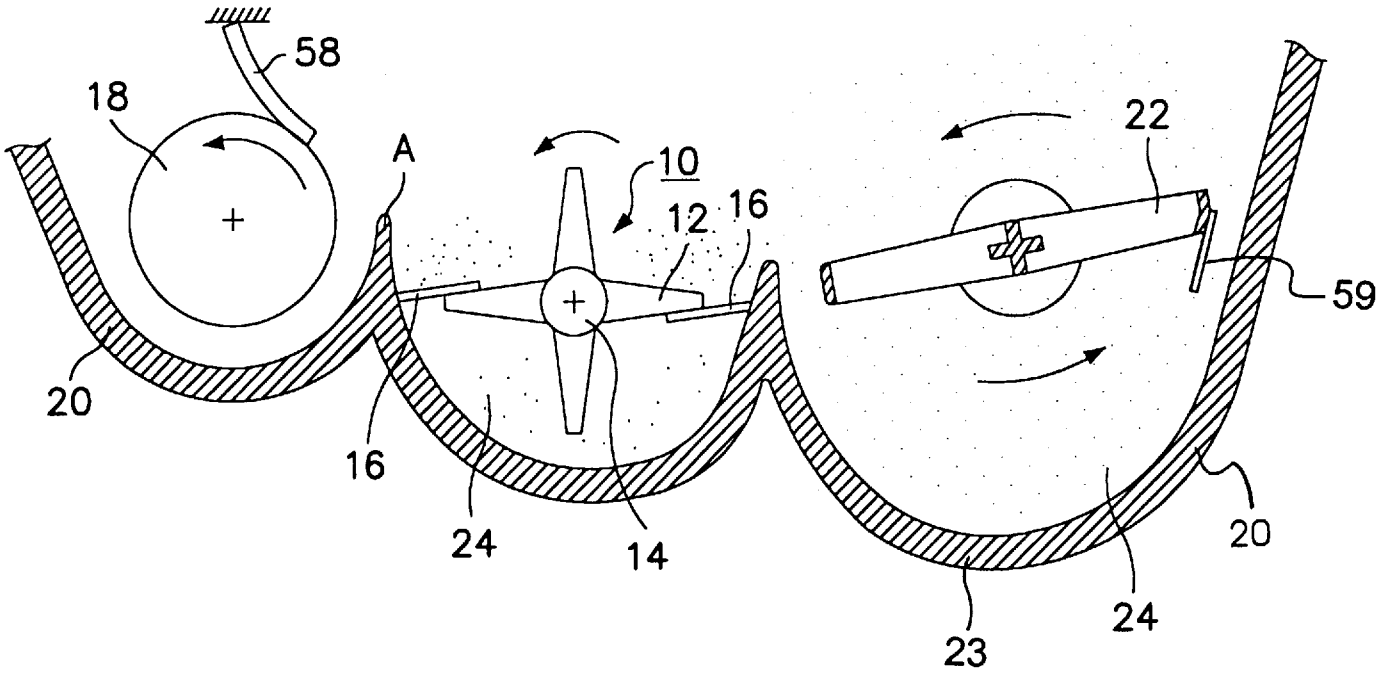
FIG. 4 is a schematic diagram illustrating the operation of a toner supply roll according to a preferred embodiment of the present invention.
Figure 5:
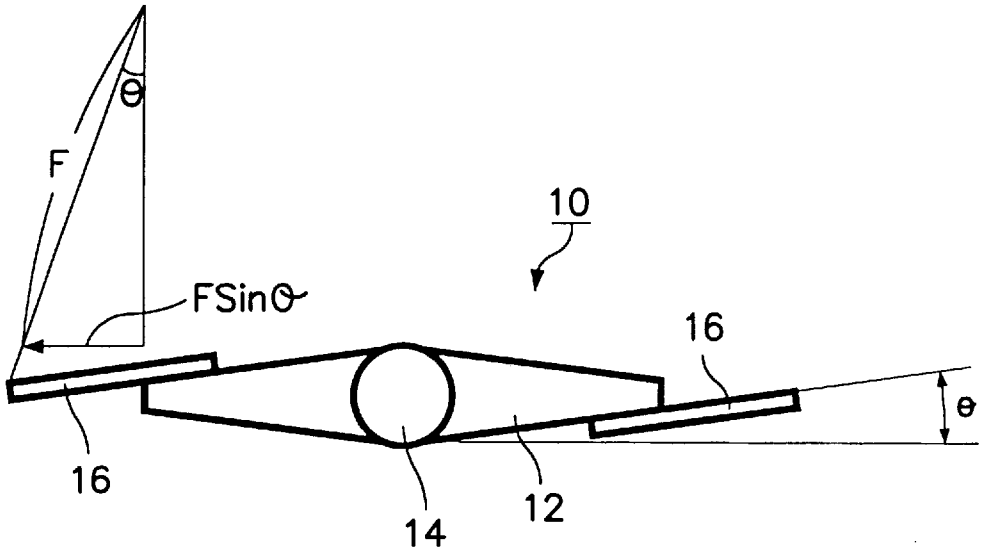
FIG. 5 is a diagram for illustrating the force exerted by the inventive toner supply roll on the toner.
Figure 6:
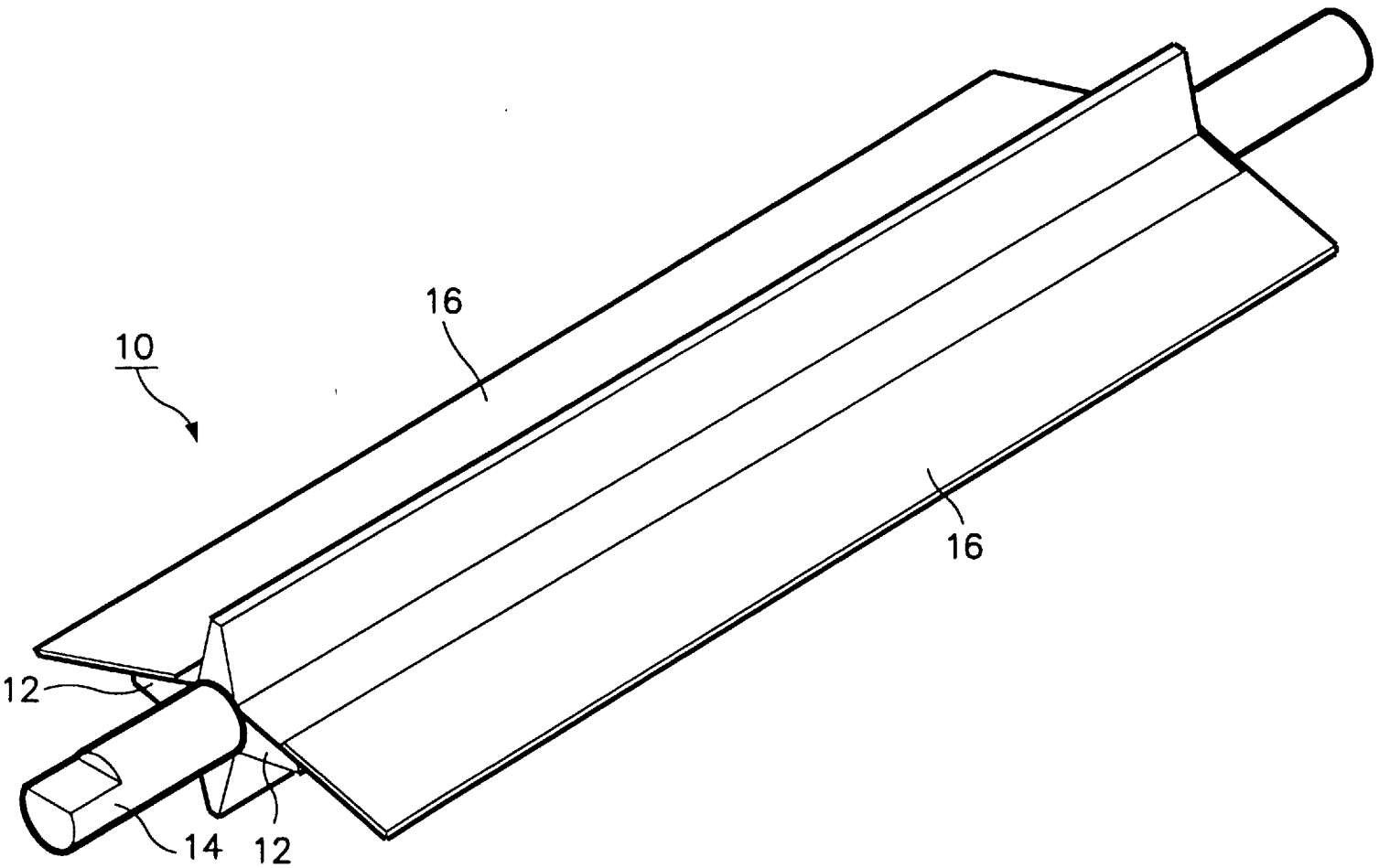
FIG. 6 is a perspective view illustrating the inventive toner supply roll.

Referring now to FIG. 4, toner 24 contained in toner receptacle 23 is agitated by an agitator 22, charged with static electricity, and delivered to a toner supply roll 10, which is installed to the left side of agitator 22 to supply toner 24 to a developing roll 18. The toner supply roll 10 consists of a central shaft 14 driven by a drive motor (not shown) and a cross-shaped blade 12 attached to the periphery of shaft 14, as shown in greater detail in FIG. 6. The toner supply roll 10 is rotated counterclockwise. Each branch of cross-shaped blade 12 is tapered toward the outer end at a given angle so as to properly supply toner 24 to developing roll 18. Namely, as shown in FIG. 5, the tapered angle of each branch creates the additional force "F.sinΘ" to push toner 24 toward developing roll 18 when toner supply roll 10 is rotated counterclockwise.

The developing unit 50 may be provided with two or more toner supply rolls 10 (FIG. 4). The cross-shaped blade 12 has at least an auxiliary film 16 attached to one of the branches to enhance the supplying force of toner supply roll 10. The auxiliary film 16 may be attached to each of the branches or to two opposite branches. The auxiliary film 16 has a sufficient size to be resiliently bent when contacting the inside of frame 20 so as to enhance the force for supplying toner 24 to developing roll 18.

The developing roll 18 is installed at a higher position than, and to the left side of, the toner supply roll 10 so as to develop a latent image on photosensitive drum 54 (FIG. 1) with toner 24. Also provided is a doctor blade 58 (FIG. 4) for regulating the thickness of the toner layer formed on toner developing roll 18 at a given level.

In operation, toner 24 contained in toner receptacle 23 of developing unit 50 is agitated by agitator 22 to charge it with static electricity by means of friction. The agitator 22 is rotated counterclockwise to deliver toner 24 to toner supply roll 10. When shaft 14 of toner supply roll 10 is driven by a drive motor (not shown), the tapered angle "Θ" (FIG. 5) of the branches of cross-shaped blade 12 creates an additional force "F.sinΘ" which is exerted on auxiliary films 16 attached to the branches of cross-shaped blade 12. The force "F.sinΘ" helps auxiliary film 16 supply sufficient amount of toner 24 over boundary part "A" (FIG. 4) of frame 20 to developing roll 18. The toner 24 deposited on developing roll 18 is regulated by doctor blade 58 so that toner 24 is maintained at a given level to carry out the subsequent printing process.

Thus, supply of a proper amount of toner to the developing roll is achieved so as to attain a printed image of high quality, and to minimize the amount of the toner remaining in toner receptacle.

While only certain embodiments of the invention have been specifically described herein, it will be apparent that numerous modifications may be made thereto without departing from the spirit and scope of the invention.

What is claimed is:

1. A developing unit in an electrophotographic apparatus having a photosensitive drum, comprising:

a frame including a toner receptacle for containing toner;

an agitator for agitating said toner contained in said toner receptacle;

a developing roll for developing a latent image formed on a surface of said photosensitive drum with said toner; and at least one toner supply roll having a shaft and a cross-shaped blade mounted thereon for supplying the agitated toner to said developing roll;

said cross-shaped blade having a plurality of branches, each of said branches extending from a center of said cross-shaped blade to a respective outer end thereof, each of said branches being tapered at a given angle so that an inner width of each of said branches nearest said center of said cross-shaped blade is greater than an outer width of said each of said branches nearest said outer end thereof, whereby to properly supply said toner to said developing roll.

2. A developing unit as defined in claim 1, wherein said cross-shaped blade has an auxiliary film attached to each of said branches to enhance a supplying force of said toner supply roll.

3. A developing unit as defined in claim 2, wherein said auxiliary film has a sufficient size so as to be resiliently bent when contacting an inside of said frame, thereby enhancing the supplying force of said toner supply roll.

4. A developing unit as defined in claim 1, further comprising a doctor blade mounted in proximity to said developing roll for regulating a thickness of the toner layer formed on said developing roll.

5. A developing unit in an electrophotographic apparatus having a photosensitive drum, comprising:

a frame including a toner receptacle for containing toner;

an agitator for agitating said toner contained in said toner receptacle;

a developing roll for developing a latent image formed on a surface of said photosensitive drum with said toner; and at least one toner supply roll having a shaft and a cross-shaped blade mounted thereon for supplying the agitated toner to said developing roll;

wherein said cross-shaped blade has at least one branch which extends from a center of said cross-shaped blade to an outer end thereof, and wherein said at least one branch is tapered at a given angle so that an inner width of said at least one branch nearest said center of said cross-shaped blade is greater than an outer width of said at least one branch nearest said outer end thereof, whereby to properly supply said toner to said developing roll.

6. A developing unit as defined in claim 5, wherein said cross-shaped blade has an auxiliary film attached to said at least one branch to enhance a supplying force of said toner supply roll.

7. A developing unit as defined in claim 6, wherein said auxiliary film has a sufficient size so as to be resiliently bent when contacting an inside of said frame, thereby enhancing the supplying force of said toner supply roll.

8. A developing unit as defined in claim 5, further comprising a doctor blade mounted in proximity to said developing roll for regulating a thickness of the toner layer formed on said developing roll.

9. A developing unit in an electrophotographic apparatus having a photosensitive drum, comprising:

a frame including a toner receptacle for containing toner;

an agitator for agitating said toner contained in said toner receptacle;

a developing roll for developing a latent image formed on a surface of said photosensitive drum with said toner;

at least one toner supply roll having a shaft and a cross-shaped blade mounted thereon for supplying the agitated toner to said developing roll; and a doctor blade mounted in proximity to said developing roll for regulating a thickness of the toner layer formed on said developing roll;

wherein said cross-shaped blade has a plurality of branches, each of said branches extending from a center of said cross-shaped blade to a respective outer end thereof, each of said branches being tapered at a given angle so that an inner width of each of said branches nearest said center of said cross-shaped blade is greater than an outer width of said each of said branches nearest said outer end thereof, whereby to properly supply said toner to said developing roll, and wherein said cross-shaped blade has an auxiliary film attached to each of said branches to enhance a supplying force of said toner supply roll.

10. A developing unit as defined in claim 9, wherein said auxiliary film enhances the supplying force of said toner supply roll by resiliently bending when contacting an inside of said frame.

* * * * *